US005608810A

United States Patent [19]

Hall

[11] Patent Number: 5,608,810

[45] Date of Patent: Mar. 4, 1997

[54] LOUDSPEAKER STRUCTURE

[75] Inventor: David Hall, San Jose, Calif.

[73] Assignee: Velodyne Acoustics, Inc., San Jose, Calif.

[21] Appl. No.: 608,928

[22] Filed: Feb. 29, 1996

Related U.S. Application Data

[63] Continuation of Ser. No. 300,444, Sep. 2, 1994, abandoned.

[51] Int. Cl.[6] ..... H04R 25/00

[52] U.S. Cl. ..... 381/193; 381/202; 181/172

[58] Field of Search ..... 381/193, 202, 381/195, 199, 205, 188, 86; 181/171, 172

[56] References Cited

U.S. PATENT DOCUMENTS

| | | | |
|---|---|---|---|
| 3,430,728 | 3/1969 | Dunning | 181/31 |
| 3,645,355 | 2/1972 | Long . | |
| 3,684,052 | 8/1972 | Sotome | 381/193 |
| 3,933,219 | 1/1976 | Butler | 181/144 |
| 3,940,576 | 2/1976 | Schultz | 179/181 |
| 4,163,877 | 8/1979 | Schonstedt | 179/146 |
| 4,204,096 | 5/1980 | Barcus et al. | 381/205 |
| 4,590,332 | 5/1986 | Delbuch | 381/193 |

FOREIGN PATENT DOCUMENTS

| | | | |
|---|---|---|---|
| 185493 | 9/1985 | Japan | 381/193 |
| 0198299 | 9/1987 | Japan | 381/202 |
| 140099 | 6/1991 | Japan | 381/199 |

*Primary Examiner*—Sinh Tran
*Attorney, Agent, or Firm*—Bielen, Peterson & Lampe

[57] ABSTRACT

A loudspeaker structure utilizing a curved member or cone having an endless rim and a continuous curved surface between the rim. A rigid support is attached to the endless rim in order to provide a mounting structure for the curved member. A surround formed of vibration damping material is connected to the rim of the curved member. A former for voice coil is connected to the curved member and extends outwardly from the continuous curved surface. The voice coil is placed on the former at a predetermined distance from the continuous curved surface.

8 Claims, 3 Drawing Sheets

LOUDSPEAKER STRUCTURE

This is a continuation of application Ser. No. 08/300,444, filed Sep. 2, 1994 now abandoned.

BACKGROUND OF THE INVENTION

The present invention concerns a loudspeaker structure possessing very low distortion.

Sound reproduction by loudspeakers entails the objective of creating sound of high quality and realism. Acoustic distortion has always posed a signification problem in this regard.

To reduce distortion, many systems have been proposed. For example, U.S. Pat. No. 3,940,576 shows a loudspeaker having a sound funneling element of a elliptical shape which extends away from a central cone.

U.S. Pat. Nos. 3,430,728 and 4,163,877 propose mounting enclosures that include resilient supports.

Japanese patents 140099 and 185493 describe speaker systems that use elastic substances on the periphery of the speaker cone to dampen sound emanating from a speaker and to presumptively decrease distortion.

A loudspeaker structure which greatly reduces distortion and is easily altered for use as either a midrange unit or a woofer would be a notable advance in the acoustics field.

SUMMARY OF THE INVENTION

In accordance with the present invention a novel and useful loudspeaker structure is herein provided.

The structure of the present invention employs a curved member or cone having an endless rim and a continuous curved surface therebetween. That is to say, the opening normally found in a conventional speaker cone is absent in the present invention. The continuous curved surface may be concave or convex and include an opposite surface of opposite curvature. A layer of damping material may be interposed between the surfaces of the curved member. Such structure is especially useful when the speaker cone is employed in a vehicle.

The curved member is connected to a rigid support generally at the endless rim portion thereof. The rigid support may be used to mount the curved member in an enclosure or sound plenum. In certain embodiments, the rigid support may include a plurality of legs terminating in a closed loop, in the form of an octagonal plate, which lies adjacent the endless rim of the curved member. The plurality of legs connect to the magnetic structure of the speaker at a distance from the curved member.

The loudspeaker structure of the present invention also possesses a surround formed of vibration damping material. The surround is connected to the endless rim of the curved member and the closed loop of the rigid support. The surrounds may be formed of relatively thin flexible material or of a relatively rigid material possessing sound damping qualities. The latter type of surround raises the resonance frequency of the curved member to create a midrange speaker. On the other hand, the relatively flexible surround permits the curved member to be employed as a woofer or low frequency unit. The woofer version of the loudspeaker structure of the present invention could be used as an active or passive radiator in a speaker enclosure. Curved members employed for the midrange or woofer versions of the speaker structure may be of the same physical dimensions.

A former may be connected to the curved member at either the concave or convex surfaces thereof. The former extends outwardly from the continuous curved surface and is surrounded by an electrical voice coil spaced from the connection of the former to the continuous curved surface and positioned within the permanent magnet structure.

It may be apparent that a novel and useful loudspeaker structure has herein been described.

It is therefore an object of the present invention to provide a loudspeaker structure that utilizes a curved member having an endless rim and a continuous curved surface without a conventional opening for a voice coil former.

Another object of the present invention is to provide a loudspeaker structure which greatly eliminates harmonic distortion through a defined range of generated sounds.

A further object of the present invention is to provide a loudspeaker structure which may utilize a curved member having an endless rim and a continuous curved surface that may be easily altered into a midrange unit or a woofer by placement of a surround, about the endless rim of the curved member, of varying stiffness and sound damping capabilities.

A further object of the present invention is to provide a loudspeaker structure which is easily dampened by surrounds of various stiffnesses and materials.

Yet another object of the present invention is to provide a loudspeaker structure which is easy to manufacture and is very durable.

Yet another object of the present invention is to provide a loudspeaker structure which is relatively free of harmonic distortion and is capable of handling high power output levels from a driving unit.

The invention possesses other objects and advantages especially as concerns particular characteristics and features thereof which will become apparent as the specification continues.

For a better understanding of the invention, reference is made to the following detailed description of the preferred embodiments thereof which should be referenced to the prior described drawings.

DETAILED DESCRIPTION OF THE PREFERRED EMBODIMENTS

Various aspects of the present invention will evolve from the following detailed description of the preferred embodiments thereof which should be taken in conjunction with the hereinbefore described drawings.

Figure 3:
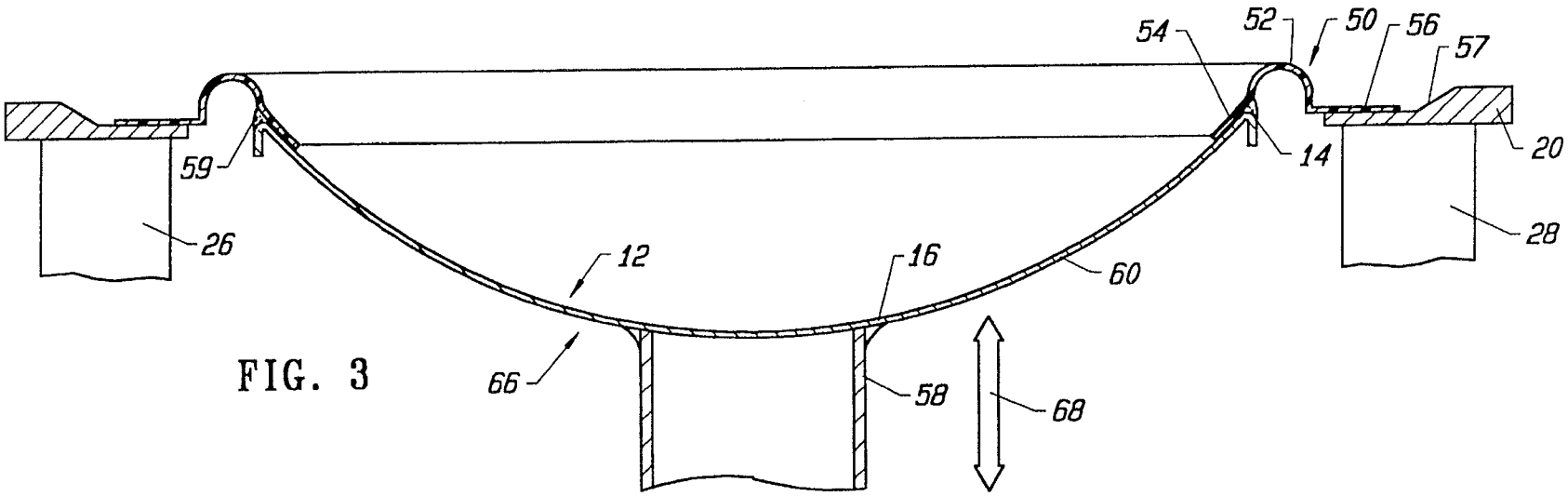
FIG. 3 is a sectional view of the woofer version of the speaker of the present invention.

The invention as a whole is depicted in the drawings by reference character 10. The speaker unit 10 includes as one of its elements a curved member 12 having an endless rim 14 and a continuous curved surface 16 therebetween, FIGS. 3, 4, and 6. Curved member 12 may be formed of any rigid or semi-rigid material. In the embodiments depicted in the drawings, curved member 12 is formed of spun-aluminum in a bowl-shaped configuration. Curved member 12 may also be referred to as a cone, although lacking any openings for voice coil linkage found in conventional speaker cones.

Rigid support or frame 18, which may be formed of metallic material, is also employed in the present invention. Support 18 possesses a closed loop in the form of an irregular octagonal plate 20 having a circular opening 22 through the same. Support legs 24, 26, 28, and 30 append from octagonal plate 20. Magnetic structure 32 includes permanent magnets 34 and 36 which are disk-shaped and are stacked upon one another. Pole pieces 38 and 40 sandwich permanent magnets 34 and 36 together. With respect to FIG. 1, it may be observed that legs 24 and 30 include a pair of rods 42 and 44, respectively. Such rods 42 and 44 connect legs 24 and 30 to pole pieces 38 and 40. Legs 26 and 28 include similar pairs of rods used for the same purpose (not shown). Plurality of openings 46 permit the use of multiplicity of fasteners 48 to connect legs 24, 26, 28, and 30 to octagonal plate 20.

Figure 1:
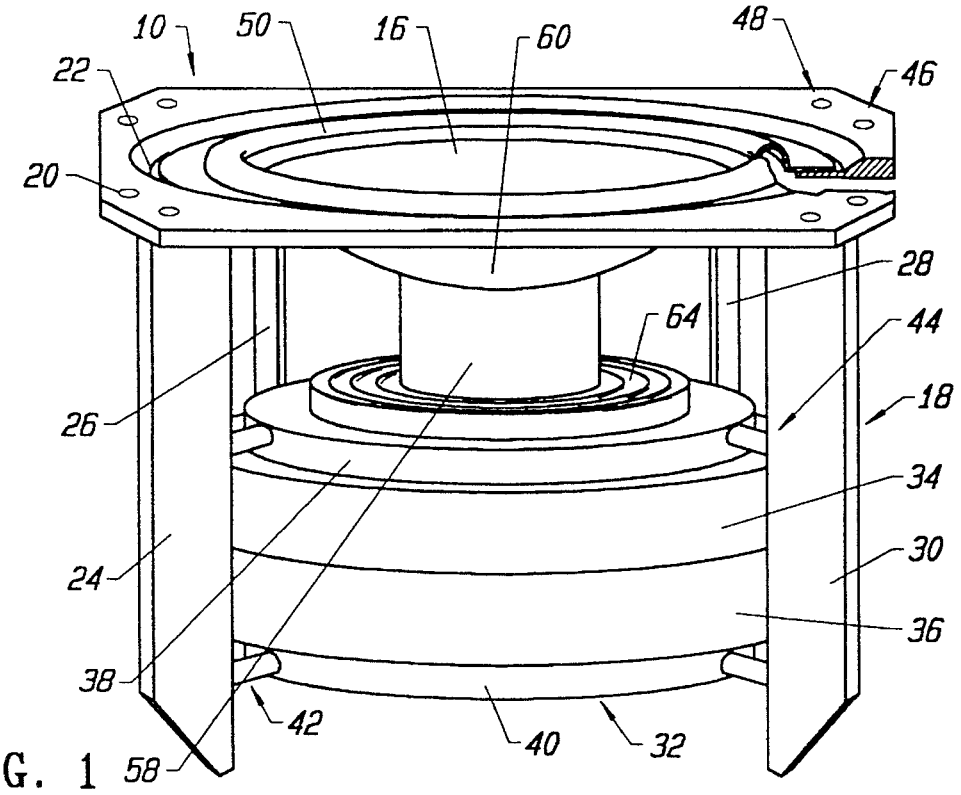
FIG. 1 is a top side isometric view of the speaker structure of the present invention which used as a woofer or low frequency unit.

The present loudspeaker structure also includes a surround 50 formed of vibration damping material which connects curved member 12 to octagonal plate 20. As depicted in FIG. 1, surround 50 is relatively thin and includes a rolled portion 52 between flattened end portions 54 and 56. End portion 54 is connected to surface 16 of curved member 12 while end portion 56 fastens to groove 57 of octagonal plate 20. Mastic bead 59 aids in this endeavor. In either case, end portion 54 and 56 are connected to continuous curved surface 16 and octagonal plate 20 by a mastic or similar means. Former 58 is glued or welded to rear surface 60 of curved member 12 and extends downwardly toward magnetic structure 32. Voice coil 62, which lies below diaphragm or spider 64, FIG. 1 interacts with magnetic structure 32 pursuant to electrical acoustic signals received from a conventional driving unit (not shown). Vibration of former 58 and cone 12 is indicated by large directional arrow 66, FIG. 3. Since surround 50 is relatively flexible, the unit depicted in FIGS. 1 and 3 may be employed as a woofer 66.

Figure 4:
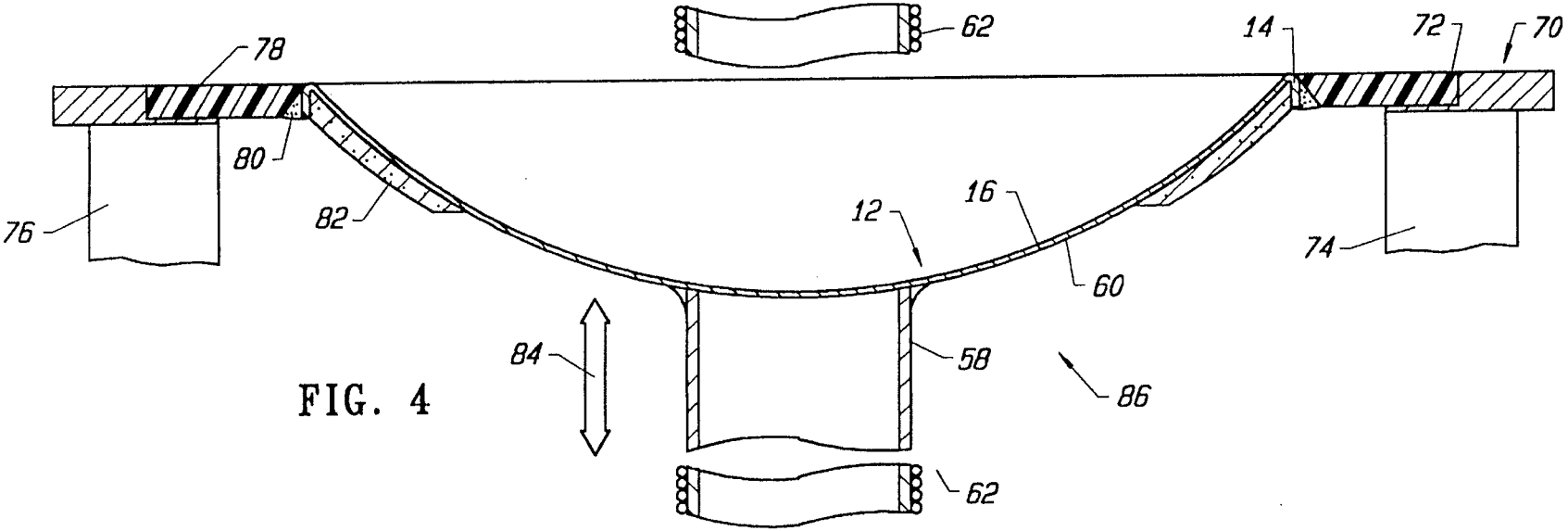
FIG. 4 is a sectional view of the midrange unit version of the present invention.

Referring now to FIG. 4, it may be observed that curved member 12 is again depicted as having a continuous curved surface 16 of concave configuration, opposite convex surface 60 (not shown) connects to a former 58 having a voice coil 62 associated with a magnetic structure similar to magnetic structure 32 as shown in FIG. 1. Curved member 12 is used in conjunction with an octagonal plate 70 including a groove 72 of slightly different configuration than groove 57 of octagonal plate 20, FIG. 3. Legs 74 and 76 and two additional legs (not shown) depend from octagonal plate 70 and are affixed to a magnetic structure similar to magnetic structure 32 and in a manner identical to the connection depicted with respect to legs 24, 26, 28 and 30, FIG. 1. A relatively stiff, yet resilient, surround 78 links cone 12 to octagonal plate 70 by the use of a mastic bead 80 placed adjacent surround 78 and endless rim 14, FIG. 4. In addition, glue, mastic, or other fastening means holds relatively stiff surround 78 to groove 72 of octagonal plate 70. Foam layer 82 on convex surface 60 further serves to dampen the vibration of cone 12. Thus, the movement of cone 12 in FIG. 4 is indicated by relatively small directional arrow 84 and is more limited than the movement of cone 12 used in conjunction with surround 50 in FIG. 3, according to relatively large directional arrow 68. It has been found that relatively stiff surround 78 elevates the resonant audio frequency of cone 12 by at least 100 hertz. Thus, cone 12 in FIG. 4 in conjunction with relatively stiff surround 78 may be employed as a midrange unit 86.

Figure 2:
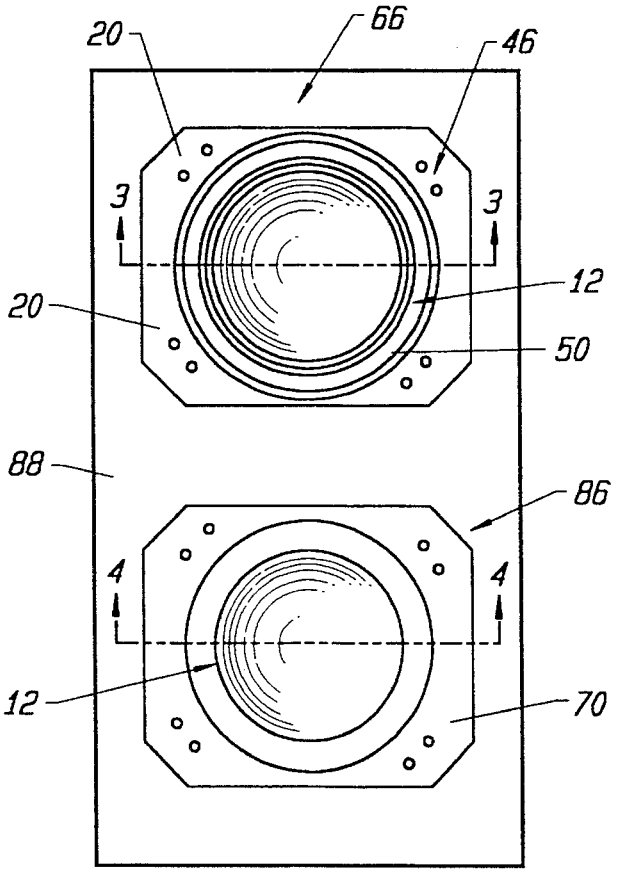
FIG. 2 is a front elevational view of a speaker having a pair of speaker structures employing the cone of the present invention mounted on plenum for use as a woofer and a midrange unit.

With respect to FIG. 2, it should be observed that midrange unit 86 and woofer 66 are mounted on an exemplar platform or plenum 88. Of course, acoustic electrical signals are fed to woofer 66 and midrange unit 86 in a conventional manner. It should be noted that woofer 66 may be used as a passive radiator rather than being driven by an electrical signal.

Figure 5:
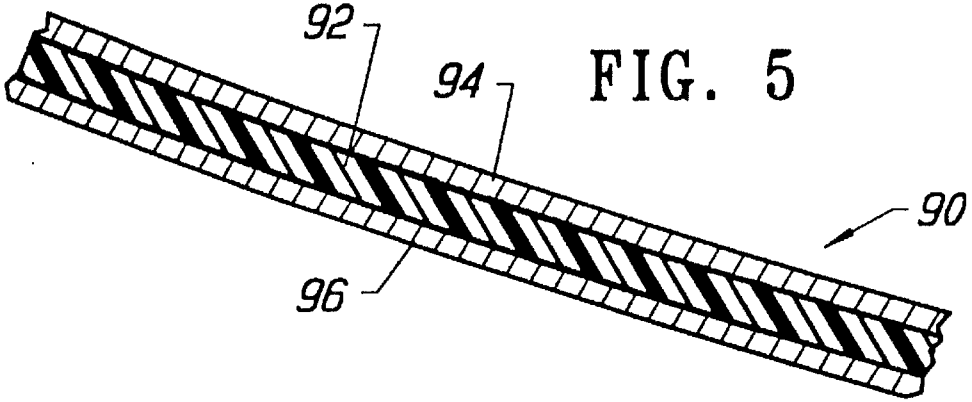
FIG. 5 is a sectional view showing an alternate laminated structure of the continuous curved member or cone.

Turning to FIG. 5, it may be seen that a curved member 90 portion is depicted. Curved member 90 may take the same form as curved member 12 and include an inner elastomeric or damping layer 92, such as foam plastic, enclosed by outer layers 94 and 96 which may be metallic material such as spun aluminum. The structure of FIG. 5 may be employed with either woofer 66 or midrange unit 86 to prevent radial movement during use. Such structure finds particular applicability in vehicles.

Figure 6:
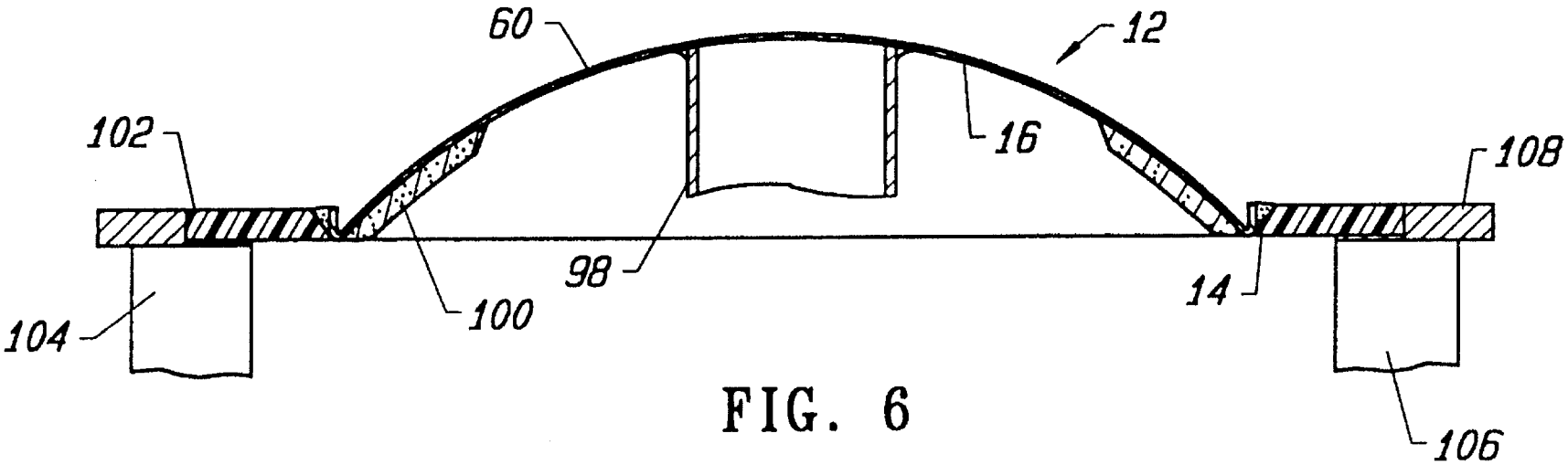
FIG. 6 is a sectional view illustrating a midrange unit of the speaker structure of the present invention where the convex surface is used for emanating sound.

Turning now to FIG. 6, it may be observed that cone 12 may be employed with a voice coil former 98 affixed to concave surface 16. This convex surface 60 radiates acoustic waves in the configuration of FIG. 6. A foam band or layer 100 lies on the edge of surface 16 adjacent endless rim 14 to further dampen acoustic radiation from cone 12. A relatively stiff surround 102 is depicted in FIG. 6, although the flexible type surround, such as surround 50 of FIG. 3, may also be employed with cone 12 in the configuration depicted in FIG. 6. Of course, former 98 includes a voice coil and interacting magnetic structure to which legs 104 and 106 are attached in the manner depicted in FIG. 1. An octagonal plate 108, similar in construction to octagonal plate 70, is also shown in FIG. 6.

In operation, the loudspeaker structure of the present invention utilizing cone 12, having a continuous, uninterrupted curved surface 16, may be employed as either a woofer or a midrange unit by the use of a particular surround. For example, surround 50 of relatively flexible configuration would connect to octagonal member 20 and render cone 12 for use as a woofer 66. In contrast, using a relatively stiff surround 78 in conjunction with octagonal plate 70 would transform curved member or cone 12 into a midrange unit 86. Both units may be mounted on a plenum 88 and be employed with further speakers such as a tweeter (not shown). It has been found that using a relatively stiff resilient surround such as surround 78 lowers the cone break-up frequency and creates a midrange unit. The opposite is true with respect to woofers 66 in which the cone break-up frequency is relatively high. Stiffness of surround 78 raises the resonant frequency by greater than 100 hertz to create the unit depicted in FIG. 4 and used in conjunction with woofer 66 as depicted in FIG. 2. Woofer 66 and midrange 86 may be separately driven by conventional electrical acoustical signals. However, woofer 66 may serve as a passive radiator such that only midrange unit 86 is electrically driven.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A loudspeaker structure comprising:

a. a curved member having an endless rim and a continuous, curved surface therebetween, said curved member possessing a particular resonant audio frequency, said continuous, curved surface being a concave surface and further including an opposite surface;

b. a surround formed of vibration damping material, said surround being connected to said endless rim of said curved member, said surround possessing a stiffness sufficient to limit movement of and to elevate said particular resonant audio frequency of said curved member greater than one-hundred hertz;

c. a rigid support having a portion attached to said surround;

d. a former connected to said opposite surface of said curved member, said former extending outwardly from said continuous curved surface; and e. an electrical coil located on said former and spaced from said opposite surface of said curved member connected to said former.

2. The structure of claim 1 in which said opposite surface is a continuous convex surface.

3. The structure of claim 1 in which a layer of damping material interposed said continuous, curved surface and said opposite surface.

4. The structure of claim 3 in which said opposite surface is a continuous curved surface.

5. The structure of claim 1 which additionally comprises a mastic layer linking said surround to said curved member.

6. The structure of claim 1 in which said curved surface curves in one direction.

7. The structure of claim 1 in which said curved member, said rigid support, said surround, said former, and said coil are a first curved member, first rigid support, a first surround, a first former, a first electrical coil, and said structure further comprises:

a. a second curved member having an endless rim and a continuous curved surface therebetween;

b. a second surround formed of flexible material relative to said first surround connected to said rim of said second curved member;

c. a second rigid support having a portion attached to said second surround;

d. a second former connected to said second curved member, said second former extending outwardly from said continuous curved surface of said second curved member;

e. a second electrical coil located on said second former and spaced from said second curved member, said second electrical coil connected to said second former; and f. a platform, said first and second rigid supports being mounted on said platform.

8. The structure of claim 7 in which said platform includes a first opening and a second opening, said first rigid support being mounted to said platform at said first opening and said second rigid support being mounted to said platform at said second opening.

* * * * *